US008127540B2

(12) United States Patent
Harada

(10) Patent No.: US 8,127,540 B2
(45) Date of Patent: Mar. 6, 2012

(54) EXHAUSTER FOR MOTORCYCLE AND MOTORCYCLE INCLUDING EXHAUSTER

(75) Inventor: Keiichi Harada, Shizuoka (JP)

(73) Assignee: Yamaha Hatsudoki Kabushiki Kaisha, Iwata-shi (JP)

( * ) Notice: Subject to any disclaimer, the term of this patent is extended or adjusted under 35 U.S.C. 154(b) by 912 days.

(21) Appl. No.: 11/877,528

(22) Filed: Oct. 23, 2007

(65) Prior Publication Data

US 2008/0110155 A1 May 15, 2008

(30) Foreign Application Priority Data

Oct. 24, 2006 (JP) ..... 2006-288460

(51) Int. Cl.
*F01N 3/00* (2006.01)
*F01N 3/10* (2006.01)
*F01N 1/00* (2006.01)
*F01N 1/02* (2006.01)

(52) U.S. Cl. ..... 60/324; 60/276; 60/299; 60/323; 181/249; 181/251

(58) Field of Classification Search ..... 60/276, 60/299, 323, 324; 96/388; 181/249, 251, 181/255, 269
See application file for complete search history.

(56) References Cited

U.S. PATENT DOCUMENTS 5,360,081 A * 11/1994 Takegami ..... 180/309
5,984,045 A * 11/1999 Maeda et al. ..... 181/254
6,546,722 B2 4/2003 Sagara et al.
6,554,099 B2 * 4/2003 Uegane ..... 181/275
6,745,863 B2 * 6/2004 Tsukui et al. ..... 180/309
2002/0033018 A1 3/2002 Sagara et al.
2002/0033303 A1 * 3/2002 Nagai et al. ..... 181/237
2005/0061580 A1 * 3/2005 Wiemeler et al. ..... 181/254
2005/0189166 A1 * 9/2005 Kikuchi et al. ..... 181/237
2006/0000205 A1 1/2006 Bozmoski et al.

FOREIGN PATENT DOCUMENTS

JP 63-208612 8/1988
JP 08061040 A * 3/1996
JP 2000097008 A * 4/2000

OTHER PUBLICATIONS

Dictionary.com, Definition of "box", retrieved May 26, 2010.*
Masaaki Hata, machine translation of JP 2000-097008 A, Apr. 4, 2000.*
Masaaki Hata, English abstract of JP 2000-097008 A, Apr. 4, 2000.*
Kohei Tomita, machine translation of JP 08-061040 A, Mar. 5, 1996.*
Kohei Tomita, English abstract of JP 08-061040 A, Mar. 5, 1996.*
European Search Report for corresponding European application 07254037.0 lists the references above.

* cited by examiner

*Primary Examiner* — Thomas Denion
*Assistant Examiner* — Audrey K Bradley
(74) *Attorney, Agent, or Firm* — Rabin & Berdo, PC

(57) ABSTRACT

An exhauster for a motorcycle with a reduced number of components and reduced cost in a structure containing a variable passage area valve. An exhaust chamber has a box-shaped chamber main body, a plurality of expansion chambers a through c formed by sectioning the interior of the chamber main body with partitioning walls, and communication passages for connecting the expansion chambers a through c with one another. A variable passage area valve that controls passage area is contained in the communication passage.

20 Claims, 7 Drawing Sheets

EXHAUSTER FOR MOTORCYCLE AND MOTORCYCLE INCLUDING EXHAUSTER

RELATED APPLICATIONS

This application claims the benefit of priority under 35 USC 119 of Japanese patent application nos. 2006-288460, filed on Oct. 24, 2006, which application is hereby incorporated by reference in its entirety.

BACKGROUND OF THE INVENTION

1. Field of the Invention

The present invention relates to an exhauster for a motorcycle that has a first exhaust pipe connected with an engine, an exhaust chamber connected with the first exhaust pipe, and a second exhaust pipe connected with the exhaust chamber.

2. Description of Related Art

An exhauster for a motorcycle having a V-type four-cylinder engine in related art includes left and right front exhaust pipes connected with left and right front cylinders, left and right rear exhaust pipes connected with left and right rear cylinders, an expansion chamber connected with these four exhaust pipes, and a pair of left and right mufflers connected with the expansion chamber (for example, see JP-B-7-111139).

According to JP-B-7-111139, a pair of left and right exhaust control valves (passage area control mechanism) for varying passage area is provided at downstream end openings of the left front and rear exhaust pipes and at downstream end openings of the right front and rear exhaust pipes inside the expansion chamber so as to improve engine output.

An exhauster structure in the related art containing a pair of passage area control mechanisms on both the left and right sides within the expansion chamber has disadvantages in an increased number of components and increased costs.

SUMMARY OF THE INVENTION

The invention has been developed to solve the problems in the related art, and provides an exhauster for a motorcycle with a reduced number of components and reduced cost in a structure containing a passage area control mechanism.

An exhauster for a motorcycle according to the invention includes a first exhaust pipe connected with an engine, an exhaust chamber connected with the first exhaust pipe, and a second exhaust pipe connected with the exhaust chamber. The exhaust chamber has a box-shaped chamber main body, a plurality of expansion chambers formed by sectioning the interior of the chamber main body with partitioning walls, and communication passages connecting the respective expansion chambers with one another. A passage area control mechanism capable of controlling passage area is contained in at least in one of the communication passages.

According to the invention, the interior of the exhaust chamber is sectioned into plural expansion chambers, and the passage area control mechanism is contained in at least in one of the communication passages for connecting the respective expansion chambers with one another. Thus, only one passage area control mechanism is required even for a plural-cylinder engine having plural exhaust pipes, which reduces the number of components and reduces costs.

Moreover, since the passage area control mechanism is contained in any of the communication passages for Connecting the respective expansion chambers with one another, the communication passage can be used as a component constituting a part of the passage area control mechanism, thereby simplifying the valve structure.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Figure 1:
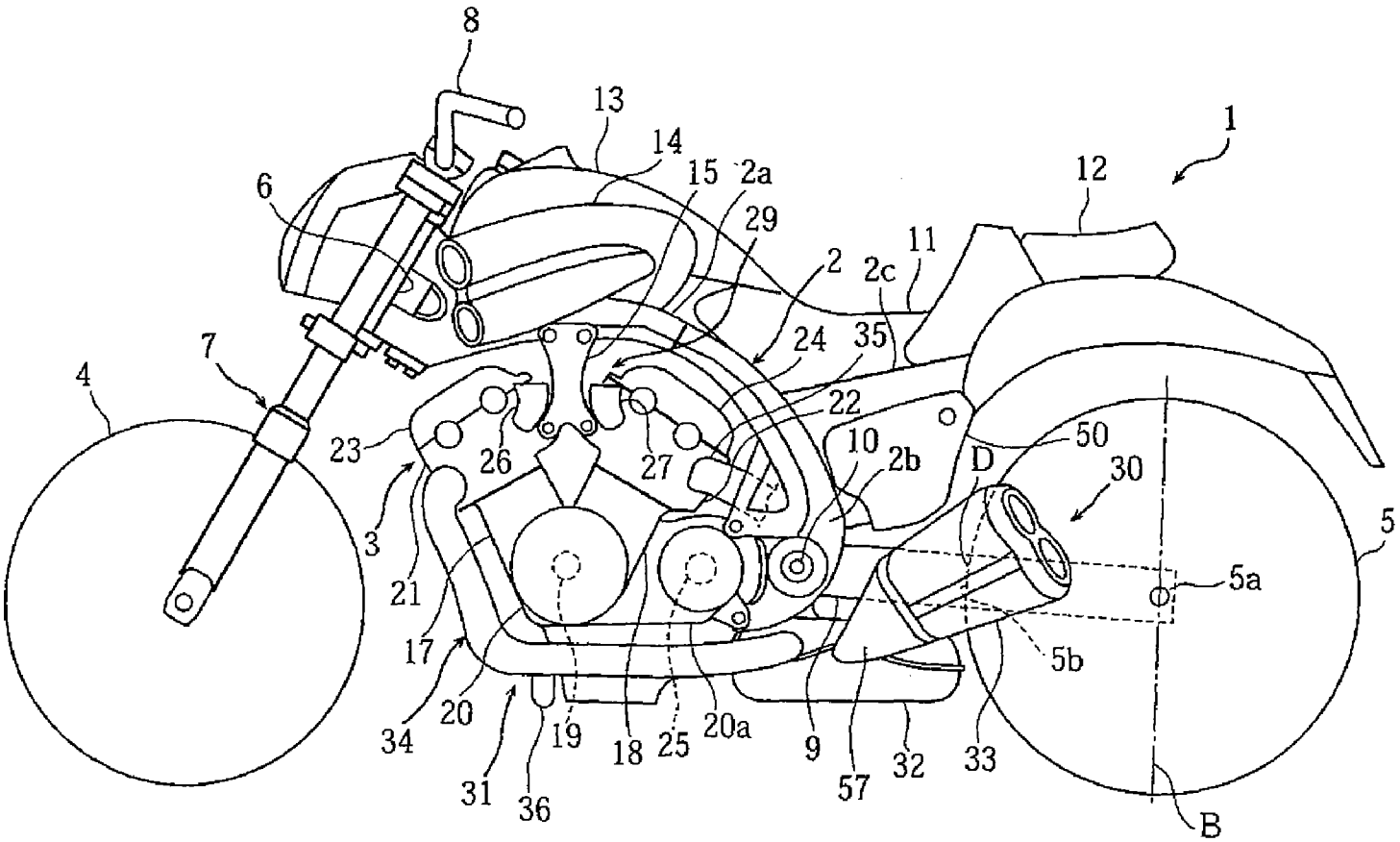
FIG. 1 is a side view of a motorcycle including an exhauster according to an embodiment of the invention.
Figure 2:
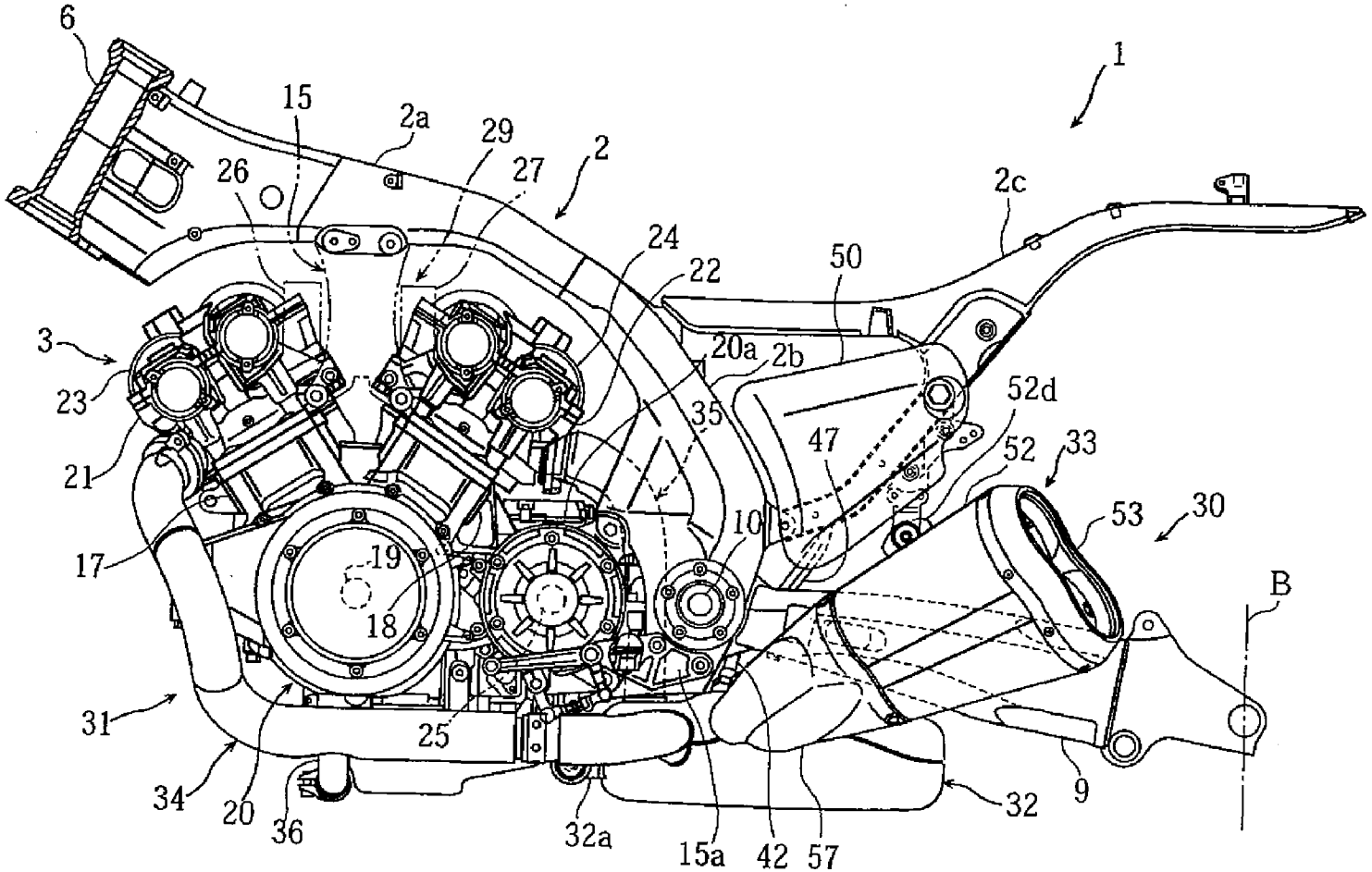
FIG. 2 is a side view of an engine connected with the exhauster and mounted on a body frame.
Figure 3:
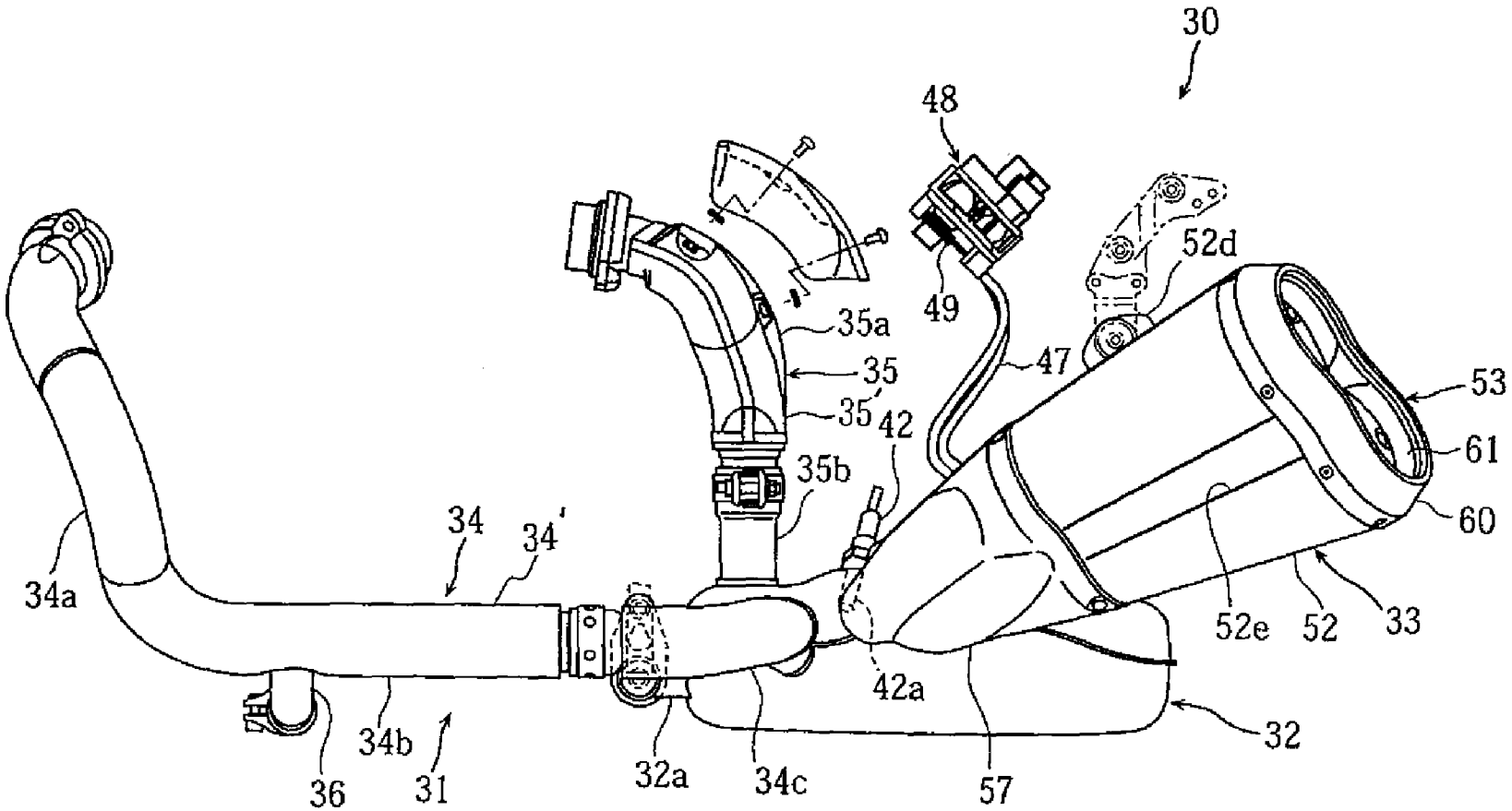
FIG. 3 is a side view of the exhauster.
Figure 4:
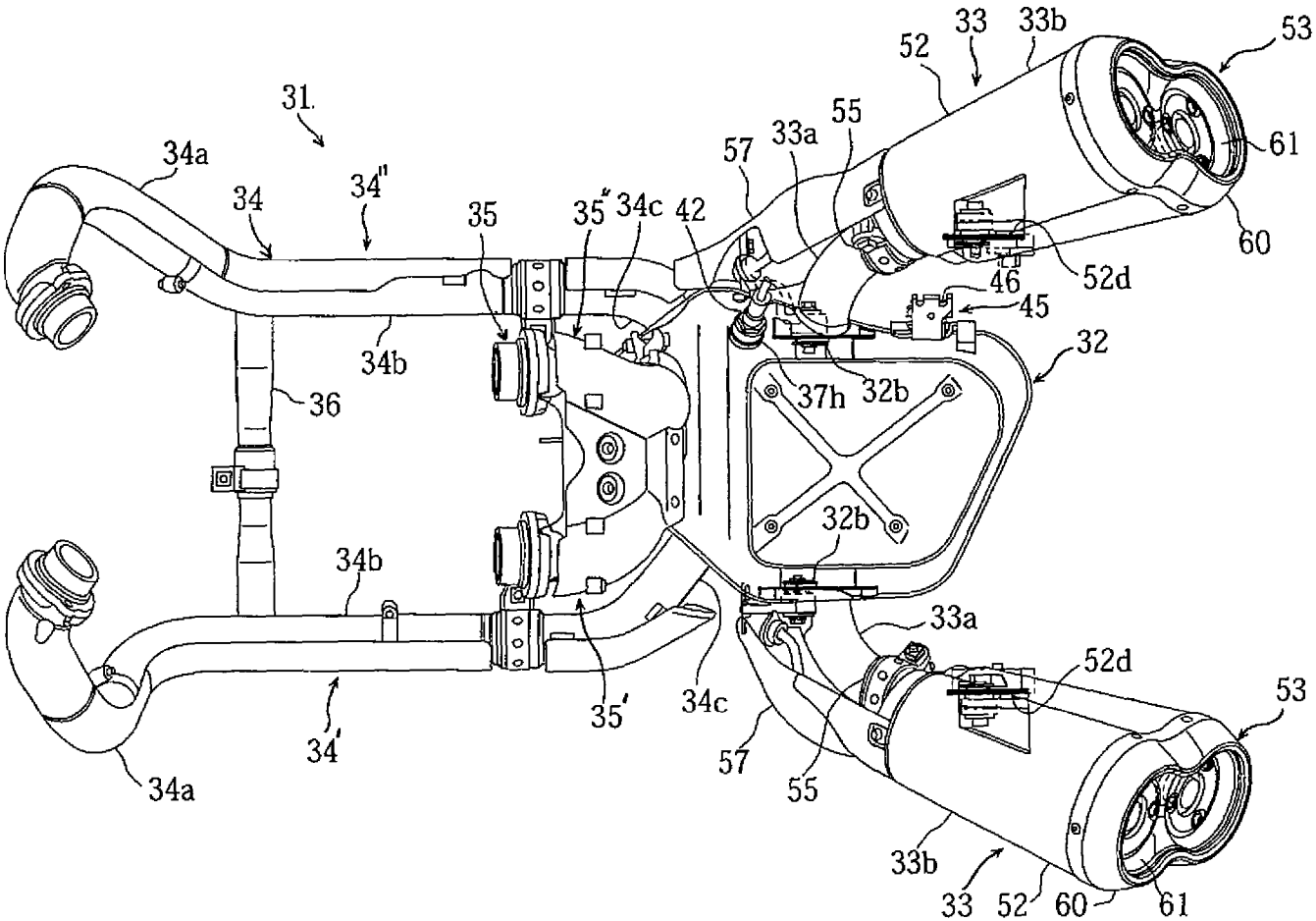
FIG. 4 is a plan view of the exhauster.
Figure 5:
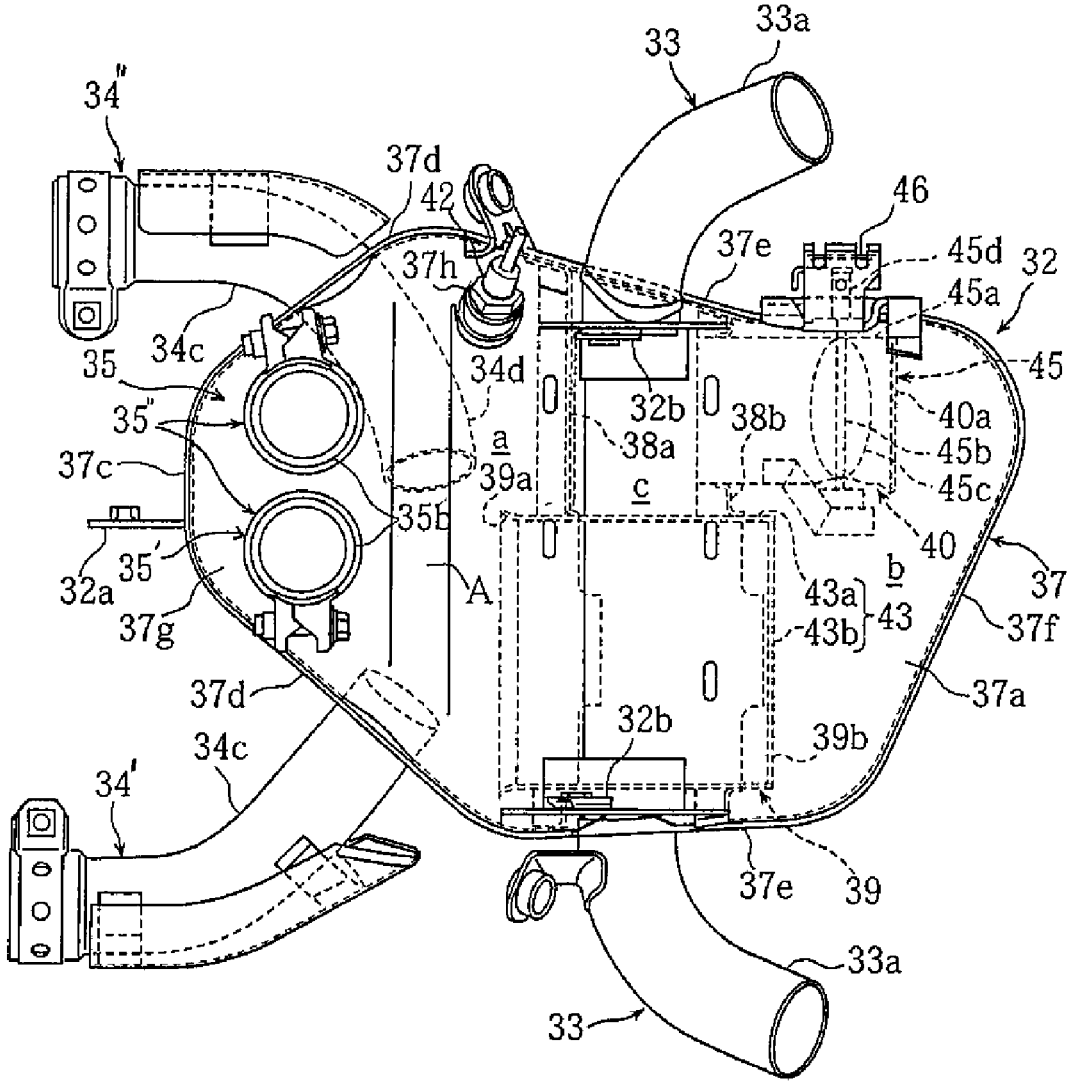
FIG. 5 is a plan view illustrating an exhaust chamber of the exhauster.
Figure 6:
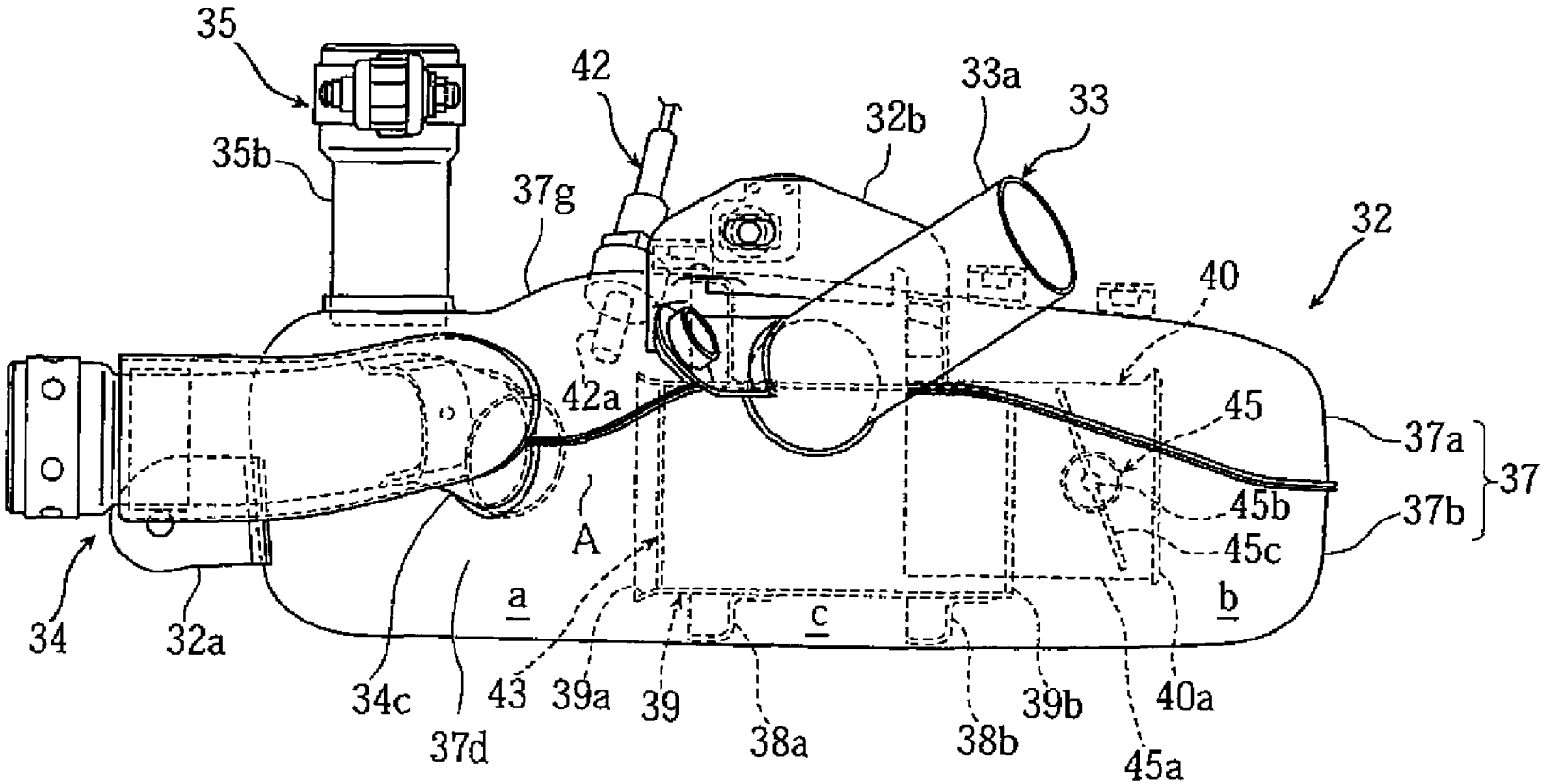
FIG. 6 is a side view of the exhaust chamber.

An embodiment of the invention is now described with reference to the appended drawings.

FIGS. 1-7 illustrate an exhauster for a motorcycle according to an embodiment of the invention. The front-rear and left-right directions in this embodiment refer to front-rear and left-right directions from the perspective of a person sitting on a seat.

In the figures, a motorcycle 1 includes a twin-spar-type body frame 2, an engine 3 mounted on body frame 2, and a front wheel 4 and a rear wheel 5 provided at the front and rear of body frame 2, respectively.

A head pipe 6 is provided at the front end of body frame 2. Left and right main frames 2*a* extend diagonally downward to the rear from head pipe 6 while expanding to the left and right, and left and right seat rails 2*c* extend diagonally upward to the rear from main frames 2*a*. A rear arm bracket unit 2*b* is disposed behind main frames 2*a*.

A front fork 7 is supported by head pipe 6 so as to be steered to the left and right. Front wheel 4 is supported at the lower end of front fork 7, and a steering handle 8 is fixed to the upper end of front fork 7.

The front end of a rear arm 9 is supported by rear arm bracket unit 2*b* via a pivot shaft 10 such that rear arm 9 can swing upward and downward. Rear wheel 5 is supported by the rear end of rear arm 9.

A straddle-type main seat 11 and a tandem seat 12 positioned behind main seat 11 are mounted on left and right seat rails 2*c*. A tank cover 13 is provided before main seat 11 as an external component.

Engine 3 is a four-stroke V-type four-cylinder engine having left and right front cylinders and left and right rear cylinders so disposed as to form a V-bank. The upper area of engine 3 is suspended by left and right suspension brackets 15, 15 fixed to left and right main frames 2*a*. The rear wall of engine 3 is suspended by a suspension bracket 15*a* fixed to rear arm bracket unit 2*b*, or by other components.

Engine 3 has a structure formed by connecting a crank case 20 containing a crank shaft 19 with lower engaging surfaces of front and rear cylinder blocks 17 and 18 forming a V-bank, connecting front and rear cylinder heads 21 and 22 with upper engaging surfaces of front and rear cylinder blocks 17 and 18, and attaching front and rear head covers 23 and 24 to front and rear cylinder heads 21 and 22.

A transmission case 20*a* containing a transmission mechanism is connected with the rear of crank case 20 as one body. The upper and bottom walls of transmission case 20*a* are fastened to rear frame 2*b* by bolts. Engine 3 has an output shaft 25 for outputting the driving force of engine 3.

An intake unit 29 of engine 3 has left front and right front intake pipes 26 and left rear and right rear intake pipes 27 provided on the V bank inside walls of front and rear cylinder heads 21 and 22 and communicating with left front and right front intake ports and left rear and right rear intake ports, respectively, and a throttle body connected with left and right front and rear intake pipes 26 and 27, and a common air cleaner connected with the throttle body.

The air cleaner is disposed below tank cover 13 between left and right main frames 2*a*, and left and right front and rear intake pipes 26 and 27 extend upward substantially in the vertical direction from the V-bank inside walls. Left and right intake ducts 14 and 14 for supplying air to engine 3 are disposed on the left and right sides of tank cover 13. Left and right air intake ducts 14 are connected with the air cleaner.

An exhauster 30 of engine 3 has an upstream (first) exhaust pipe 31 connected with engine 3, an exhaust chamber 32 connected with upstream exhaust pipe 31, and left and right mufflers (second exhaust pipes) 33, 33 connected with exhaust chamber 32. First exhaust pipe 31 has a third exhaust pipe 34 through which exhaust gas flows into a first expansion chamber a of exhaust chamber 32 from the outside to the inside substantially in the vehicle width direction, and a fourth exhaust pipe 35 through which exhaust gas flows into first expansion chamber a of exhaust chamber 32 from the upper side to the lower side substantially in the up-down direction. Third exhaust pipe 34 has a fifth exhaust pipe 34' connected with left front cylinder 17, and a sixth exhaust pipe 34" connected with right front cylinder 17. Fourth exhaust pipe 35 has a seventh exhaust pipe 35' connected with left rear cylinder 18, and an eighth exhaust pipe 35" connected with right rear cylinder 18. The details of this structure are as follows.

Upstream exhaust pipe 31 has left and right transverse exhaust pipes (fifth and sixth exhaust pipes) 34' and 34' connected with the V bank outside wall (front wall) of front cylinder head 21 and communicating with left and right front exhaust ports open to this outside wall, and left and right longitudinal exhaust pipes (seventh and eighth exhaust pipes) 35' and 35" connected with the V bank outside wall (rear wall) of rear cylinder head 22 and communicating with left and right rear exhaust ports open to this outside wall.

Each of left and right transverse exhaust pipes 34' and 34" has a downward inclined portion 34*a* extending downward from front cylinder head 21 while expanding to the outside in the vehicle width direction, a horizontal portion 34*b* extending from the lower end of inclined portion 34*a* through the lower side of crank case 20 to the rear substantially in a linear direction, and a transverse curved portion 34*c* extending from the rear end of horizontal portion 34*b* while curving toward the inside in the vehicle width direction. Left and right horizontal portions 34*b* are connected with each other via a communication pipe 36 extending in the vehicle width direction such that left and right horizontal portions 34*b* can communicate with each other.

Each of left and right longitudinal exhaust pipes 35' and 35" has a longitudinal curved portion 35*a* extending from rear cylinder head 22 through the rear side of transmission case 20*a* while curving downward, and a vertical portion 35*b* extending downward from longitudinal curved portion 35*a* substantially in a linear direction.

Exhaust chamber 32 is disposed between transmission case 20*a* of engine 3 and rear wheel 5 below rear arm 9 containing pivot shaft 10. A front flange 32*a* projecting from the front end of exhaust chamber 32 is attached to crank case 20. Left and right flanges 32*b* and 32*b* rising from the left and right edges of the upper wall of exhaust chamber 32 are attached to rear frame 2*b* via a bracket.

Exhaust chamber 32 has a closed-box-shaped chamber main body 37 formed by combining the outer edges of an upper member 37*a* and a lower member 37*b*, first, second and third expansion chambers a through c formed by sectioning the interior of chamber main body 37 in the front rear direction by first and second partitioning walls 38*a* and 38*b*, a first communication passage 39 through which first expansion chamber a communicates with second expansion chamber b, and a second communication passage 40 through which second expansion chamber b communicates with third expansion chamber c.

First through third expansion chambers a through c are disposed such that first expansion chamber a, third expansion chamber c, and second expansion chamber b are positioned in this order from the front. Second expansion chamber b is located between first expansion chamber a connected with left and right transverse exhaust pipes 34 and left and right longitudinal exhaust pipes 35, and third expansion chamber c connected with left and right mufflers 33 as viewed in the exhaust gas flowing direction.

The volume of first expansion chamber a is larger than each volume of second and third expansion chambers b and c. The volume of second expansion chamber b is larger than the volume of third expansion chamber c.

Chamber main body 37 has a substantially hexagonal shape having a front end wall 37*c*, left and right front inclined walls 37*d*, 37*d* extending from front end wall 37*c* to the rear while diagonally expanding to the outside, left and right side walls 37*e*, 37*e* extending from left and right front inclined walls 37*d* to the rear, and a rear wall 37*f* connecting the rear ends of left and right side walls 37*e* in the vehicle width direction.

Transverse curved portions 34*c*, 34*c* of left and right transverse exhaust pipes 34', 34" are connected with left and right front inclined walls 37*d* of chamber main body 37 such that transverse curved portions 34*c*, 34*c* can communicate with first expansion chamber a. Thus, exhaust gas flowing within left and right transverse exhaust pipes 34', 34" flows into first expansion chamber a from the outside to the inside in the vehicle width direction.

Right transverse exhaust pipe 34" has an extension 34*d* extending from transverse curved portion 34*c* toward the center of first expansion chamber a. Extension 34*d* is disposed behind left and right longitudinal exhaust pipes 35', 35" in first expansion chamber a, and is open to the center of exhaust pipes 35', 35" in the vehicle width direction.

Vertical portions 35*b*, 35*b* of left and right longitudinal exhaust pipes 35', 35" are disposed in parallel in the vicinity of front end wall 37*c* of chamber main body 37 in the vehicle width direction, and are connected with first expansion chamber a such that vertical portions 35*b*, 35*b* can communicate with first expansion chamber a. Thus, exhaust gas flowing within left and right longitudinal exhaust pipes 35, 35" flows into first expansion chamber a from the upper side to the lower side in the up-down direction.

A boss 37*h* is provided at an end of a top wall 37*g* of chamber main body 37 at an inner position in the vehicle width direction such that boss 37*h* can communicate with first expansion chamber a. A detection unit 42*a* of an oxygen concentration detection sensor 42 is inserted through boss 37*h* such that detection unit 42*a* can reach the interior of first expansion chamber a. Oxygen concentration detection sensor 42 is surrounded by chamber main body 37, left and right rear frames 2*b*, pivot shaft 10, and rear arm 9 such that oxygen concentration detection sensor 42 is protected from damage caused by external force.

Oxygen concentration detection sensor 42 is disposed at a position away from a junction portion A of left and right transverse exhaust pipes 34' and 34" and left and right longitudinal exhaust pipes 35' and 35" in first expansion chamber a. Extension 34*d* is disposed at a position to guide exhaust gas in a direction away from oxygen concentration detection sensor 42. The exhaust gases flowing from the respective exhaust pipes are mixed, and the gas after mixture contacts detection unit 42*a* of oxygen concentration detection sensor 42.

First communication passage 39 penetrates through first and second partition walls 38*a* and 38*b* for defining third expansion chamber c such that first expansion chamber a can communicate with second expansion chamber b. First communication passage 39 is disposed on the side opposite to oxygen concentration sensor 42 of chamber main body 37 as viewed from above, and an exhaust gas inlet 39*a* of first communication passage 39 is positioned in the vicinity of exhaust gas junction portion A of first expansion chamber a.

A catalyst 43 is contained in first communication passage 39. Catalyst 43 has a honeycomb-shaped catalyst main body 43*b* inside a metal cylindrical body 43*a* constituting communication passage 39. Catalyst main body 43*b* has a function for purifying exhaust gas.

Figure 7:
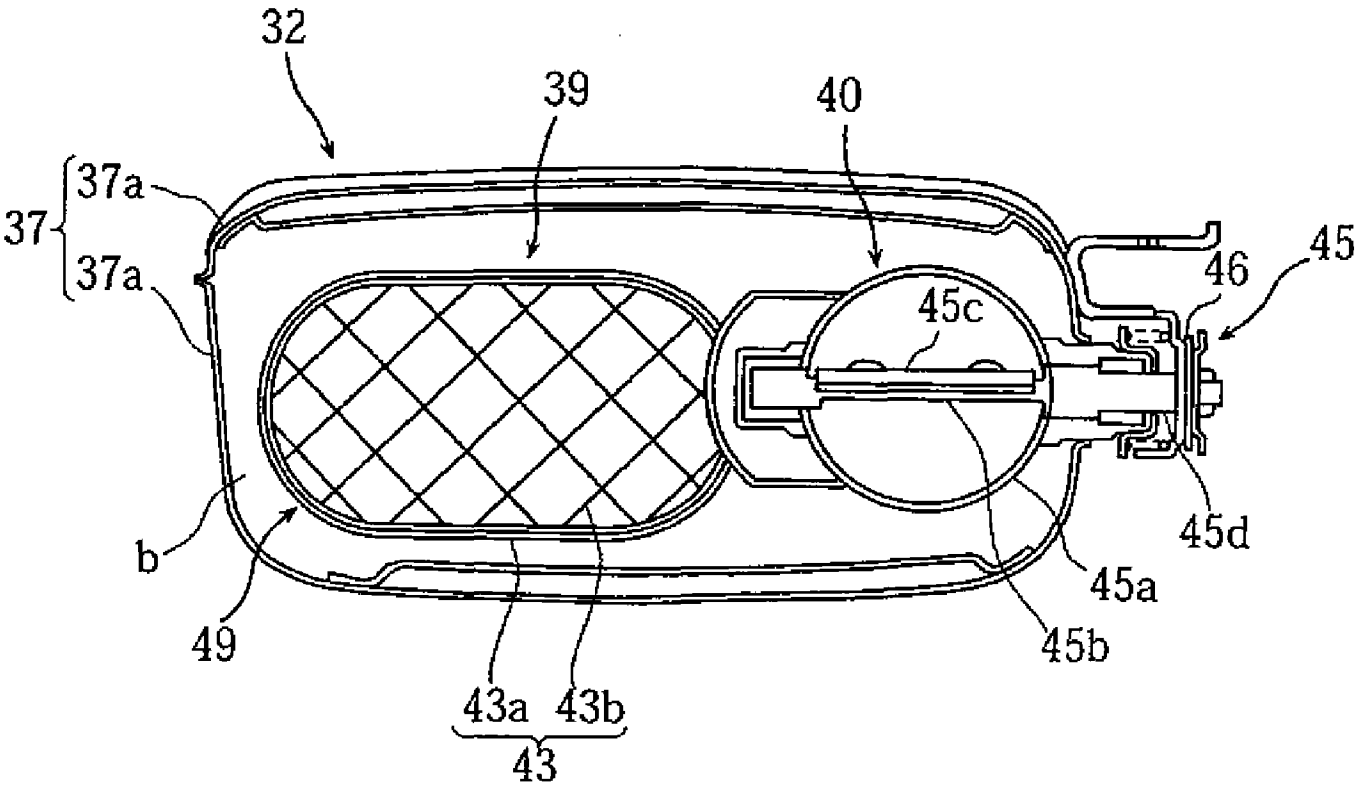
FIG. 7 is a rear cross-sectional view of the exhaust chamber.

Catalyst 43 is elliptical in the lateral cross-sectional view, and is disposed such that the major axis of the ellipse extends in the vehicle width direction (see FIG. 7).

Second communication passage 40 disposed in the vicinity of right wall 37*e* of chamber main body 37 penetrates through second partition wall 38*b* in such a condition that second expansion chamber b communicates with third expansion chamber c. Second communication passage 40 is positioned on the right side of first communication passage 39 in parallel, and an exhaust gas inlet 40*a* of second communication passage 40 is offset from an exhaust gas output 39*b* of first communication passage 30 toward the rear of the vehicle.

Exhaust gases from the respective cylinders flow through left and right transverse exhaust pipes 34' and 34" and left and right longitudinal exhaust pipes 35' and 35" into first expansion chamber a of exhaust chamber 32. Exhaust gas mixed at first expansion chamber a flows through catalyst 43 in first communication passage 39 into second expansion chamber b. Then, the exhaust gas flows from second expansion chamber b through second communication passage 40 into third expansion chamber c, from which the exhaust gas flows through left and right mufflers 33 to be released to the outside.

Second communication passage 40 contains a variable passage area valve passage area control mechanism) 45 that controls the passage area of communication passage 40.

Variable passage area valve 45 has a cylindrical communication pipe 45*a* constituting second communication passage 40, a valve shaft 45*b* disposed to penetrate through communication pipe 45*a* in the vehicle width direction, and a valve plate 45*c* fixed to valve shaft 45*b* in such a position as to lie within communication pipe 45*a*.

Valve shaft 45*b* is so located as to extend in the vehicle width direction, and the right end of valve shaft 45*b* penetrates through right wall 37*e* of chamber main body 37 to project to the outside. A driven pulley 46 attached to a projecting portion 45*d* of valve shaft 45*b* is connected with a drive pulley 49 attached to a rotation shaft of a drive motor 48 via a cable 47. Drive motor 48 is contained in a side cover 50 below seat frames 2*c*.

Variable passage area valve 45 is opened and closed by operation of a controller that detects operation conditions of the engine based on engine revolutions, engine load and other conditions, and controls the opening of variable passage area valve 45 according to the engine operation conditions.

Left and right mufflers 33 have downstream exhaust pipes 33*a*, 33*a* connected with left and right side walls 37*e*, 37*e* of exhaust chamber 32 in such a condition as to communicate with third expansion chamber c, and muffler main bodies 33*b*, 33*b* connected with left and right downstream exhaust pipes 33*a* in such a condition as to be attachable to and detachable from downstream exhaust pipes 33*a*.

As illustrated in FIG. 1, left and right mufflers 33 are disposed before a vertical line B passing through the center of a rotation axis 6*a* of rear wheel 5. A center D of left and right mufflers 33 in the front-rear direction is positioned in the vicinity of a front edge 5*b* of rear wheel 5.

Left and right mufflers 33 extend diagonally upward to the rear from exhaust chamber 32 while expanding to the outside in the vehicle width direction.

Each of left and right muffler main bodies 33*b* attached to the vehicle body via an attachment bracket 52*d* has a casing 52 that surrounds the outer circumference of a tail pipe connected with downstream exhaust pipe 33*a* via a joint 55, and a tail cap 53 so attached as to cover a rear end wall of casing 52. Tail cap 53 has a ring-shaped outer cap 60 surrounding the rear edge of casing 52, and an inner cap 61 disposed to cover the rear end wall of casing 52.

An outside cover 57 that covers the external side of downstream exhaust pipe 33*a* is provided between casing 52 and exhaust chamber 32. Outside cover 57 has a tapered shape which narrows from the casing 52 side to the upstream side (lower side), and constitutes a part of casing 52.

According to this embodiment, first expansion chamber a is linked to left and right transverse exhaust pipes 34' and 34" connected with left and right front cylinders of V-type four-cylinder engine 3, and is linked to left and right longitudinal exhaust pipes 35' and 35" connected with left and right rear cylinders of engine 3. Third expansion chamber c is linked to left and right mufflers 33; and second expansion chamber b is interposed between first and third expansion chambers a and c as viewed in the flowing direction of exhaust gas. This structure securely provides the three expansion chambers while maintaining the compactness of chamber main body 37, resulting in an increase in the substantial exhaust pipe length and an improved muffling effect.

According to the exhauster of this embodiment, left and right transverse exhaust pipes 34, and 34" and left and right longitudinal exhaust pipes 35' and 35" are connected with single exhaust chamber 32, and variable passage area valve 45 is contained in second communication passage 40 through which the respective expansion chambers can communicate with one another. Thus, only the single variable passage area valve 45 is required even in case of a four-cylinder engine having four exhaust pipes 34', 34', 35', and 35", which reduces the number of components and reduces costs.

Second communication passage 40 through which second expansion chamber b communicates with third expansion chamber c functions as communication pipe 45*a* of variable passage area valve 45. Thus, the number of components is decreased and the valve structure is simplified. In addition, since second communication passage 40 is disposed in the vicinity of right wall 37*e* of chamber main body 37, valve shaft 45*b* can project toward chamber main body 37 without necessity for extension of valve shaft 45*b*. Accordingly, the structure containing the open/close driving mechanism can be simplified. Furthermore, since valve shaft 45*b* extends in the vehicle width direction, the size of exhaust chamber 32 in the up-down direction decreases. As a result, the minimum road clearance is widened.

According to this embodiment, left and right transverse exhaust pipes 34' and 34" through which exhaust gas flows from the outside to the inside in the vehicle width direction and left and right longitudinal exhaust pipes 35' and 35" through which exhaust gas flows from the upper side to the lower side in the up-down direction are connected to first expansion chamber a of exhaust chamber 32. Thus, exhaust gases from the respective cylinders can be securely mixed within first expansion chamber a. Since catalyst 43 is contained in first communication passage 39 through which first expansion chamber a communicates with second expansion chamber b, exhaust gases from the four exhaust pipes 34 and 35 are mixed with one another and flow into catalyst 43 immediately after the mixture. As a result, purification efficiency improves while using only one catalyst. Since only one catalyst is required for the four exhaust pipes, the number of components and costs are decreased.

According to this embodiment, cylindrical body 43*a* of catalyst 43 penetrates through third expansion chamber c such that first communication chamber a can communicate with second expansion chamber b. In this case, cylindrical body 43*a* functions as first communication passage 39, and therefore the number of components is decreased.

Catalyst 42 has an elliptical shape in the vehicle width direction. Thus, the size of exhaust chamber 32 in the up-down direction decreases, thereby increasing the minimum road clearance.

According to this embodiment, right transverse exhaust pipe 34' has extension 34*d* for guiding exhaust gas from exhaust pipe 34' to a position away from oxygen concentration detection sensor 42. In this case, exhaust gas from any particular exhaust pipe does not directly contact detection unit 42*a* of oxygen concentration detection sensor 42. Thus, the air-fuel ratios of all the cylinders can be detected with high accuracy.

According to this embodiment, left and right transverse exhaust pipes 34' and 34" and left and right exhaust pipes 35' and 35" connected with V-type four-cylinder engine 3 are connected with left and right front inclined walls 37*d*, 37*d* and upper wall 37*g* of exhaust chamber 32, respectively. Thus, the respective exhaust pipes can be arranged in a compact structure without interfering with one another.

According to this embodiment, exhaust chamber 32 is interposed between engine 3 and rear wheel 5. Thus, exhaust chamber 32 having a large volume can be disposed with effective utilization of the space between engine 3 and rear wheel 5.

While, in this embodiment, variable passage area valve 45 is contained in second communication passage 40 through which second expansion chamber b communicates with third expansion chamber c, the variable passage area valve of the invention may be located at any position within the communication passages in the exhaust chamber. For example, the variable passage area valve may be contained in first communication passage 39.

While four exhaust pipes are provided in this embodiment, the invention is applicable to structures containing other numbers of exhaust pipes, such as, for example, one exhaust pipe.

The particular embodiments of the invention described in this document should be considered illustrative, rather than restrictive. Modification to the described embodiments may be made without departing from the spirit of the invention as defined by the following claims.

The invention claimed is:

1. An exhauster for a motorcycle, comprising:

a first exhaust pipe connected with an engine;

an exhaust chamber connected with the first exhaust pipe; and a second exhaust pipe connected with the exhaust chamber, wherein the exhaust chamber has a box-shaped chamber main body, a plurality of expansion chambers formed by sectioning an interior of the chamber main body with partitioning walls, and communication passages connecting the expansion chambers so that the connected expansion chambers and the communication passages are capable of forming a constant passage of exhaust gas, and further wherein a passage area control mechanism that controls passage area is contained in one of the communication passages that is the only communication passage between two of the chambers such that exhaust gas that enters the exhaust chamber must be communicated through the passage area control mechanism to exit the exhaust chamber.

2. The exhauster for a motorcycle according to claim 1, further comprising a catalyst contained in at least one of the communication passages.

3. The exhauster for a motorcycle according to claim 1, wherein the communication passages are capable of forming the constant passage of exhaust gas based on engine revolutions or engine load.

4. A motorcycle, comprising:

a rear wheel; and the exhauster according to claim 1,wherein the exhaust chamber is disposed between the engine and the rear wheel.

5. The exhauster for a motorcycle according to claim 1, wherein the exhaust chamber has:

a first expansion chamber connected with the first exhaust pipe;

a third expansion chamber connected with the second exhaust pipe; and a second expansion chamber connected between the first expansion chamber and the third expansion chamber.

6. The exhauster for a motorcycle according to claim 5, wherein the passage area control mechanism has a communication passage through which the second expansion chamber can communicate with the third expansion chamber.

7. The exhauster for a motorcycle according to claim 5, further comprising a catalyst which is contained in a communication passage through which the first expansion chamber communicates with the second expansion chamber.

8. The exhauster for a motorcycle according to claim 7, wherein the communication passage including the catalyst penetrates through the third expansion chamber.

9. The exhauster for a motorcycle according to claim 7, wherein:

the catalyst has an elliptical shape in a lateral cross-sectional view; and a major axis of the elliptical shape extends in a vehicle width direction.

10. An exhauster for a motorcycle, comprising:

a first exhaust pipe connected with an engine;

an exhaust chamber connected with the first exhaust pipe, the exhaust chamber including a box-shaped chamber main body, a plurality of expansion chambers formed by sectioning an interior of the chamber main body with partitioning walls, the expansion chambers including a first expansion chamber connected with the first exhaust pipe, a third expansion chamber, and a second expansion chamber connected between the first expansion chamber and the third expansion chamber, communication passages connecting the expansion chambers, and a passage area control mechanism that controls passage area being contained in at least one of the communication passages, wherein the passage area control mechanism has a communication pipe disposed in a vicinity of a side wall of the chamber main body, a valve shaft disposed to penetrate through the communication pipe, and a valve plate provided within the communication pipe and fixed to the valve shaft, the valve shaft extending in a vehicle width direction and penetrating through the side wall to be exposed to the outside, the passage area control mechanism having a communication passage through which the second expansion chamber communicates with the third expansion chamber; and a second exhaust pipe connected with the exhaust chamber and to the third expansion chamber.

11. An exhauster for a motorcycle, comprising:

a first exhaust pipe connected with an engine;

an exhaust chamber connected with the first exhaust pipe, the exhaust chamber including a box-shaped chamber main body, a plurality of expansion chambers formed by sectioning an interior of the chamber main body with partitioning walls, the expansion chambers including a first expansion chamber connected with the first exhaust pipe, a third expansion chamber, and a second expansion chamber connected between the first expansion chamber and the third expansion chamber, communication passages connecting the expansion chambers, and a passage area control mechanism that controls passage area being contained in at least one of the communication passages; and a second exhaust pipe connected with the exhaust chamber and to the third expansion chamber, wherein the first exhaust pipe has a third exhaust pipe through which exhaust gas flows into the first expansion chamber from an outside to an inside substantially in a vehicle width direction, and a fourth exhaust pipe through which exhaust gas flows into the first expansion chamber from an upper side to a lower side substantially in an up-down direction.

12. The exhauster for a motorcycle according to claim 11, further comprising an oxygen concentration detection sensor whose detection unit is disposed within the first expansion chamber.

13. The exhauster for a motorcycle according to claim 12, wherein:

the third exhaust pipe has an extension projecting to the inside of the first expansion chamber; and the extension is directed away from the oxygen concentration detection sensor.

14. The exhauster for a motorcycle according to claim 11, wherein:

the engine is a V-type engine having a front cylinder and a rear cylinder;

a front end of the third exhaust pipe is connected with the front cylinder; and a rear end of the third exhaust pipe is connected with a side wall of the first expansion chamber.

15. The exhauster for a motorcycle according to claim 14, wherein:

the engine is a V-type four-cylinder engine having a left front cylinder, a right front cylinder, a left rear cylinder, and a right rear cylinder; and the third exhaust pipe has a fifth exhaust pipe connected with the left front cylinder, and a sixth exhaust pipe connected with the right front cylinder.

16. The exhauster for a motorcycle according to claim 14, wherein:

the third exhaust pipe has an extension projecting to the inside of the first expansion chamber; and the detection unit of the oxygen concentration detection sensor is interposed between the extension and the side wall of the first expansion chamber connected with the extension.

17. The exhauster for a motorcycle according to claim 14, wherein:

a front end of the fourth exhaust pipe is connected with the rear cylinder; and a rear end of the fourth exhaust pipe is connected with a top wall of the first expansion chamber.

18. The exhauster for a motorcycle according to claim 17, wherein:

the engine is a V-type four-cylinder engine having a left front cylinder, a right front cylinder, a left rear cylinder, and a right rear cylinder; and the fourth exhaust pipe has a seventh exhaust pipe connected with the left rear cylinder, and an eighth exhaust pipe connected with the right rear cylinder.

19. An exhauster for a motorcycle, comprising:

a first exhaust pipe connected with an engine;

an exhaust chamber connected with the first exhaust pipe, the exhaust chamber including a box-shaped chamber main body, a plurality of expansion chambers formed by sectioning an interior of the chamber main body with partitioning walls, the expansion chambers including a first expansion chamber connected with the first exhaust pipe, a third expansion chamber, and a second expansion chamber connected between the first expansion chamber and the third expansion chamber, communication passages connecting the expansion chambers so that the connected expansion chambers and the communication passages are capable of forming a constant passage of exhaust gas, and a passage area control mechanism that controls passage area being contained in one of the communication passages that is the only communication passage between two of the chambers; and a second exhaust pipe connected with the exhaust chamber and to the third expansion chamber, wherein the first expansion chamber, the third expansion chamber, and the second expansion chamber are arranged in this order from a front of the vehicle.

20. The exhauster for a motorcycle according to claim 19, wherein the passage area control mechanism is contained in a communication passage through which the second expansion chamber communicates with the third expansion chamber.

* * * * *